United States Patent [19]

Fujimoto

[11] 4,353,239

[45] Oct. 12, 1982

[54] HAND RIVETER

[75] Inventor: Kaoru Fujimoto, Sakai, Japan

[73] Assignee: Nihon Nejimawashi Co., Ltd., Osaka, Japan

[21] Appl. No.: 272,255

[22] Filed: Jun. 10, 1981

[51] Int. Cl.[3] ..... B21J 15/34

[52] U.S. Cl. ..... 72/391

[58] Field of Search ..... 72/391, 114, 409; 81/313

[56] References Cited

U.S. PATENT DOCUMENTS

| | | | |
|---|---|---|---|
| 3,101,017 | 8/1963 | Malkin | 81/313 |
| 3,760,627 | 9/1973 | Richardson | 72/391 |
| 3,782,165 | 1/1974 | Bosch | 72/391 |
| 3,886,782 | 6/1975 | Miyamoto | 72/391 |
| 4,048,877 | 9/1977 | Undin | 81/313 |
| 4,170,154 | 10/1979 | Izraeli | 81/313 |

*Primary Examiner*—Gene Crosby

*Attorney, Agent, or Firm*—Armstrong, Nikaido, Marmelstein & Kubovcik

[57] ABSTRACT

A headed mandrel inserted through a rivet sleeve is pulled and snapped off its head by a riveter to deform the rivet sleeve for setting the rivet when a movable handlebar is pivotally moved relative to a fixed handlebar by hand. An operating bar pivotally supported by the main body of the riveter has one end pivoted to a chuck for gripping the mandrel and the other end serving as an engaging portion. A pusher is pivoted to the movable handlebar and has grooved portions engageable with the engaging portion. A bearing member pivoted to the main body is formed with bearing grooves positioned alongside the grooved portions in corresponding relation thereto and engageable with the engaging portion. When the movable handlebar is repeatedly turned, the pusher pushes the engaging portion in engagement with one grooved portion after another to engage the engaging portion correspondingly in one bearing groove after another and move the chuck by the resulting movement of the operating bar for setting the rivet.

7 Claims, 20 Drawing Figures

Fig.2
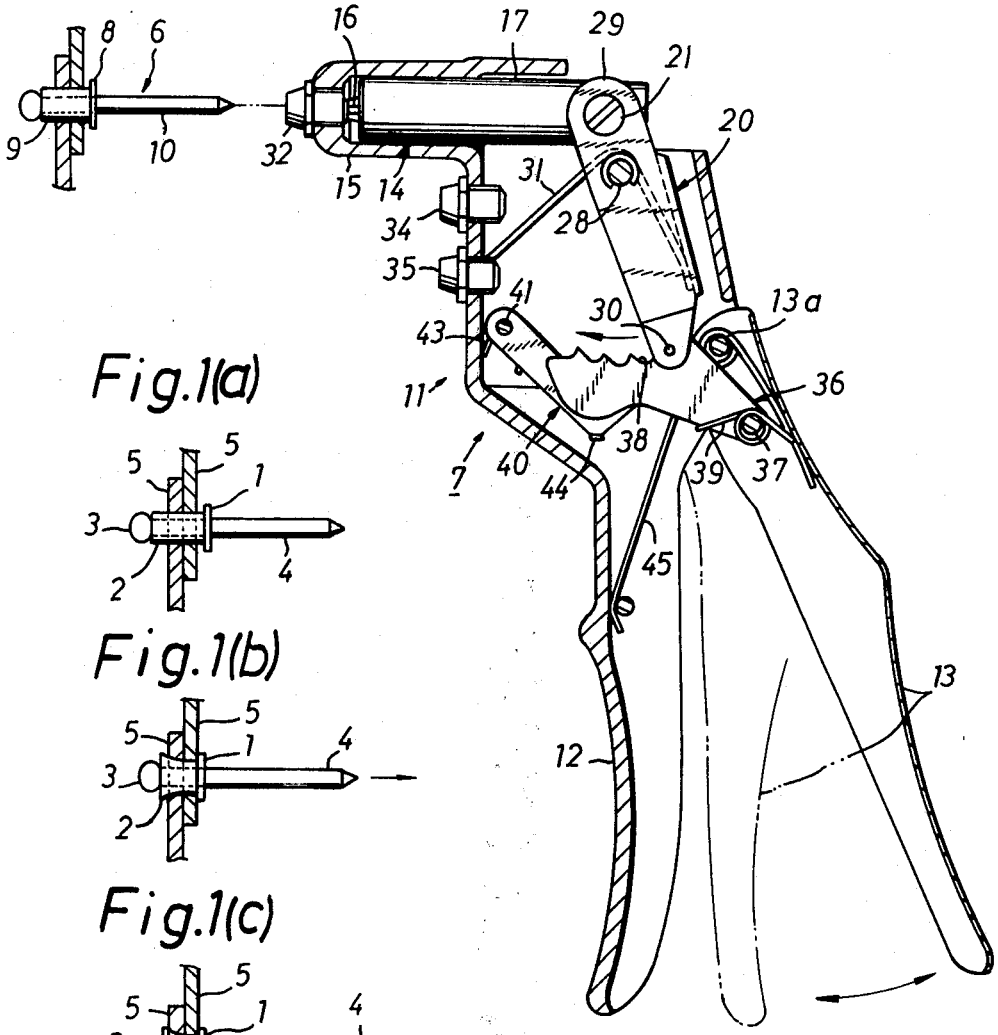
Fig.1(a)
Fig.1(b)
Fig.1(c)
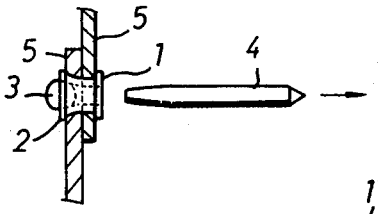
Fig.3
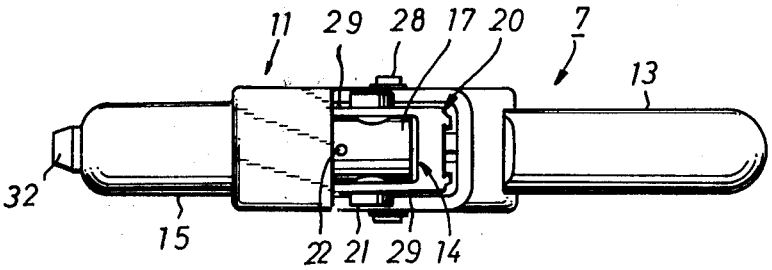

XV
XV

HAND RIVETER

BACKGROUND OF THE INVENTION

The present invention relates to a hand riveter.

Hand riveters are well known the main body of which has a fixed handlebar, a movable handlebar pivotally movable relative to the fixed handlebar, and a chuck for gripping a headed mandrel inserted through a rivet sleeve. The movable handlebar, when pivotally moved, moves the chuck, which in turn pulls the mandrel through the rivet sleeve while deforming the sleeve to snap the mandrel off its head for rivet setting.

Conventional hand riveters of the type described have many problems. They are complex in construction and cumbersome to use for the setting of rivets and returning the chuck after rivet setting. Moreover the manual rivet setting operation requires a great force.

Such hand riveters involve another problem in that the movable handlebar is coupled to the chuck by an assembly of complex construction which is cumbersome to assemble and disassemble.

SUMMARY OF THE INVENTION

An object of the present invention is to provide a hand riveter which is easy and convenient to use and which assures riveting with a reduced operating force.

Another object of the invention is to provide a hand riveter which is simplified in its overall construction, especially in the construction of an assembly for coupling the movable handlebar to the chuck, to make the coupling assembly easy to assemble or disassemble and thereby render the chuck itself also easy to assemble or disassemble and to attach to the riveter main body.

BRIEF DESCRIPTION OF THE DRAWINGS

FIG. 1 (*a*) is a diagram showing the initial stage of rivet setting with use of a hand riveter;

FIG. 1 (*b*) is a diagram showing the rivet while the mandrel thereof is being pulled;

FIG. 1 (*c*) is a diagram showing the rivet upon completion of setting;

FIG. 2 is an overall side elevation in section showing a first embodiment of the invention;

FIG. 3 is a plan view of the same;

FIG. 13 (*b*) is a perspective view showing a pivot;

DESCRIPTION OF THE PREFERRED EMBODIMENTS

Figure 4:
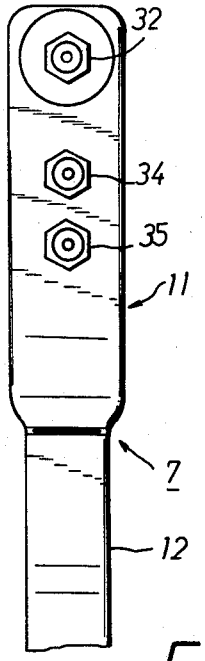
FIG. 4 is a front view of the same.
Figure 5:
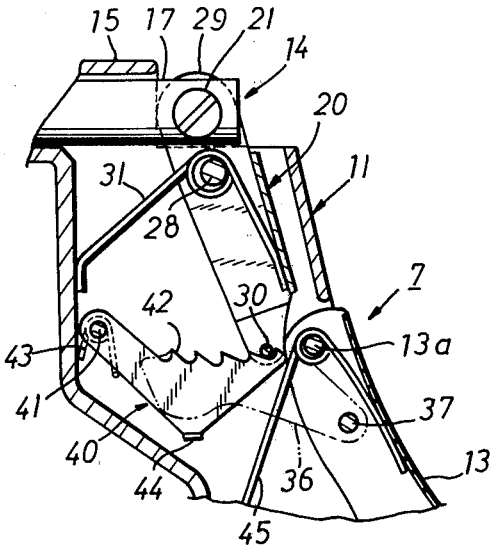
FIG. 5 is a fragmentary side elevation in section taken along a different plane to show the hand riveter of FIG. 2.
Figure 6:
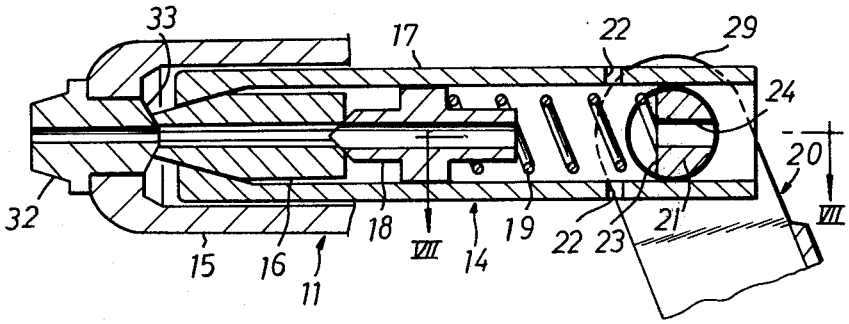
FIG. 6 is a sectional view showing a chuck.
Figure 7:
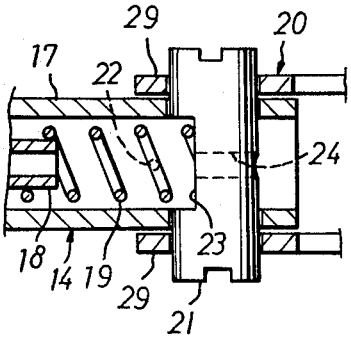
FIG. 7 is a view in section taken along the line VII—VII in FIG. 6.

FIGS. 1 (*a*) and (*c*) show stepwise how a rivet is set by a hand riveter. The rivet consists of a rivet sleeve 2 having a flange 1 at its one end, and a mandrel 4 headed as at 3 and inserted through the rivet sleeve 2, with the head 3 at the other end of the sleeve. The rivet sleeve 2 is inserted through the workpieces 5, 5 to be riveted, and the mandrel 4 is pulled by the hand riveter to deform the sleeve 2, whereby the workpieces 5, 5 are firmly joined together by the flange 1 and the sleeve end radially outwardly deformed by the head 3.

FIGS. 2 to 8 show a first preferred embodiment of the invention, namely a hand riveter 7, which is used for a rivet 6. The rivet 6 consists of a rivet sleeve 9 having a flange 8 at its one end, and a headed mandrel 10 inserted through the rivet sleeve 9 from the other end.

The main body 11 of the riveter has a fixed handlebar 12, a movable handlebar 13 pivotably supported by a pin 13*a* on the main body at a portion closer to the operator (i.e. at a rear portion) and pivotally movable relative to the fixed handlebar 12, and a chuck 14 for gripping the projecting end of the mandrel 10 through the rivet sleeve 9. The handlebars 12 and 13 are gripped and squeezed by the operator with one hand. The movable handlebar 13, when thereby pivotally moved, moves the chuck 14, which in turn pulls the mandrel 10 through the rivet sleeve 9 while deforming the sleeve 9 to snap the mandrel 10 off its head and set the rivet 6.

The chuck 14 is housed in a hollow cylindrical chuck casing 15 extending forward from the top portion of the riveter main body 11 and integral therewith. The rear portion (closer to the operator) of the chuck 14 is slightly movable upward and downward.

The chuck 14 comprises a jaw 16 composed of circumferentially arranged divided segments and having an inner bore of variable diameter for gripping the mandrel 10 when the diameter is decreased, a tubular casing 17 having a conical bore for accommodating the jaw 16 to axially push the jaw 16 in contact therewith and thereby reduce the inside diameter of the jaw 16, an expanding spring 19 accommodated in the tubular casing 17 axially slidably for biasing the jaw 16 through a wedge member 18 to enlarge the inside diameter of the jaw 16, and a pivot 21 connecting the tubular casing 17 to the movable end of an operating bar 20 pivoted to the riveter main body 11. At a location between the wedge member 18 and the pivot 21, the tubular casing 17 has holes 22, 22 diametrically extending therethrough.

The pivot 21 is withdrawably inserted axially thereof through the tubular casing 17 and the operating bar 20. The pivot 21 is formed in its outer periphery with a planar cutout portion 23 positioned in the middle of its length in parallel to its axis. In the center of the cutout portion 23, a bore 24 extends through the pivot 21 across its axis. One end of the expanding spring 19 opposite to the other end thereof bearing on the wedge member 18 is fitted in and supported by the cutout portion 23. The expanding spring 19 thus retained restrains the pivot 21 from axial movement to hold the tubular casing 17 in connection with the operating bar 20.

The pivot 21, when turned in this position about its own axis, moves the cutout portion 23 circumferentially of the pivot relative to the expanding spring 19, releasing the spring 19 from the cutout portion 23, whereby the pivot 21 is made withdrawable from the tubular casing 17 and the operating bar 20. When the pivot 21 is thus removed, the chuck 14 is removable from the rivet main body 11, and the chuck 14 can be separated into the tubular casing 17, expanding spring 19 and jaw 16.

Figure 8:
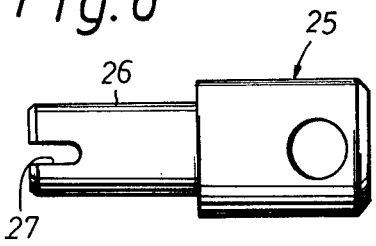
FIG. 8 is a view showing a stepped rod serving as a tool for coupling a movable handlebar to the chuck.
Figures 9, 10, 11:
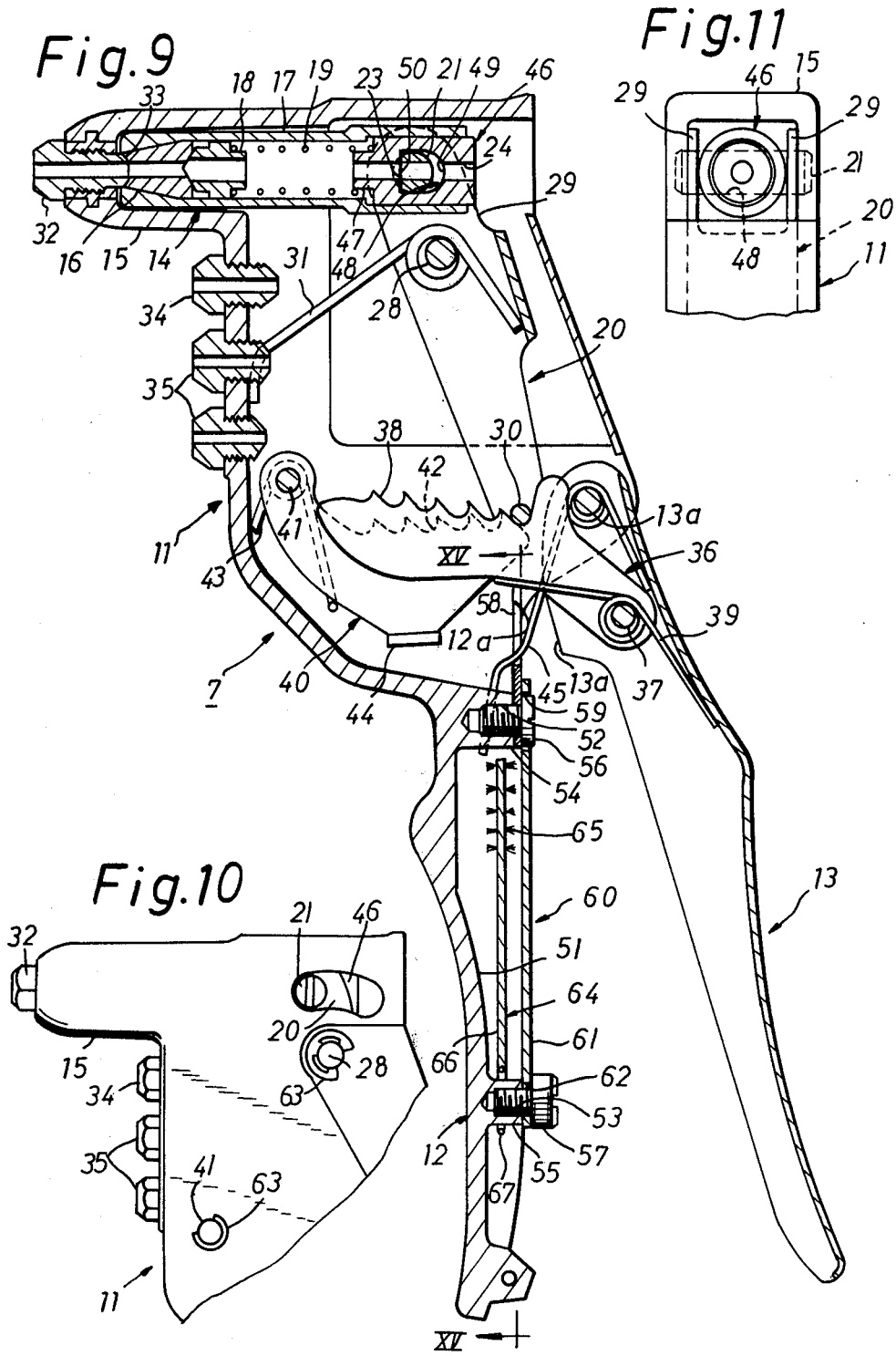
FIG. 9 is an overall side elevation in section showing a second embodiment of the invention.
FIG. 10 is a fragmentary side elevation showing the same.
FIG. 11 is a fragmentary rear view of the same.
Figure 12:
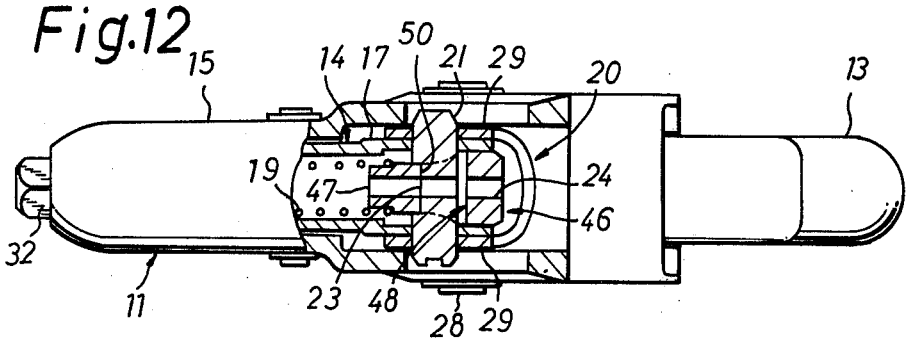
FIG. 12 is a plan view showing the same partly in section.

Conversely the chuck 14 can be assembled and mounted on the riveter main body 11 by inserting the jaw 16, wedge member 18 and expanding spring 19 into the tubular casing 17 through the rear open end thereof, inserting a small-diameter shank 26 of a stepped rod 25 shown in FIG. 8 into the tubular casing 17 against the action of the expanding spring 19, inserting an unillustrated pin through the holes 22 and a cutout 27 at the forward end of the shank 26, remving the stepped rod 25, fitting the pivot 21 in place and removing the pin.

Thus the chuck 14 is easy to assemble and disassemble for the inspection, repair and replacement of parts.

The operating bar 20 is channel-shaped in cross section and is turnably supported by a lateral pivot 28 on the riveter main body 11. Opposed plates 29, 29 extending from one end of the bar 20 have the tubular casing 17 positioned therebetween, and at this portion the operating bar 20 is connected to the casing 17 by the pivot 21. The operating bar 20 has at the other end thereof a lateral pin serving as an engaging portion 30. The lateral pivot 28 is provided with a return spring 31 for biasing the operating bar 20 in a direction to press the chuck 14 against the front end of the chuck casing 15.

A tubular nosepiece 32 is removably screwed in the front end opening of the chuck casing 15. Inside the chuck casing 15, the nosepiece 32 has an wedging end 33 which is held in pressing contact with the front end of the jaw 16 by the action of the return spring 31. The wedging end 33 coacts with the wedge member 18 to increase the inside diameter of the jaw 16. Spare nosepieces 34 and 35 of the same or different inside diameters are detachably attached to the riveter main body 11 in screw-thread engagement therewith.

A pusher 36 pivoted to the movable handlebar 13 by a pin 37 is formed in its upper edge with serrated grooved portions 38 engageable with the engaging portion 30 and opened obliquely forward. The pin 37 is provided with a pusher spring 39 for pressing one of the grooved portions 38 against the engaging portion 30.

A bearing member 40 pivoted by a pin 41 on the riveter main body 11 above the fixed handlebar 12 is formed in its upper edge with serrated bearing grooves 42 alongside the grooved portions 38 in corresponding relation thereto. The bearing grooves 42 are engageable with the engaging portion 30 and are substantially identical with the grooved portions 38 in shape and size. A bearing spring 43 attached to the pin 41 presses one of the bearing grooved portions 42 against the engaging portion 30. The bearing member 40 is provided at one side thereof with an engaging projection 44, which is struck by the pusher 36 to release the engaging portion 30 from the bearing groove 42 when the pusher 36 is turned to disengage the grooved portion 38 from the engaging portion 30.

When the movable handlebar 13 is repeatedly turned, the pusher 36 pushes the engaging portion 30 in engagement with one grooved portion 38 after another to engage the engaging portion 30 correspondingly in one bearing groove 42 after another. With this movement, the operating bar 20 intermittently retracts the chuck 14. As the jaw 16 moves away from the wedging end 33, the jaw 16 diametrically contracts to grip the mandrel 10. As the chuck 14 further moves rearward, the mandrel 10 deforms the rivet sleeve 9 for rivet setting.

A handle spring 45 attached to the pin **13*a* determines the position of the movable handlebar 13 as spaced from the fixed handlebar 12. When the movable handlebar 13 is turned from the above position in an opening direction against the handle spring 45 after the handlebar 13 has been repeatedly turned to advance the engaging portion 30 and retract the chuck 14, the pin 13*a* turns the pusher 36 downward, causing the pusher 36 to push the engaging projection 44 to move the bearing member 40 with the pusher 36. Consequently the engaging portion 30 is released from the grooved portion 38 and the bearing groove 42, whereupon the chuck 14 is returned to the original position by the return spring 31. With the chuck 14 returned to its original position, the engaging portion 30 automatically engages in the rearmost grooved portion 38**.

The hand riveter 7 having the foregoing construction is used in the following manner. First, a mandrel 10 is inserted through the nosepiece 32 and the jaw 16, and a rivet sleeve 9 through a hole formed in the workpieces to be riveted. If at this time the jaw 16 is caused to grip the mandrel 10 by initially moving the movable handlebar 13 with the mandrel 10 inserted through the nosepiece 32 and the jaw 16, the sleeve 9 can be inserted through the riveting hole easily and properly with the rivet 6 prevented from slipping off the hand riveter 7 in whatever direction the riveting hole may be formed.

With the flange 8 pressed against the work by the nosepiece 32, the movable handlebar 13 is turned with one hand by gripping to retract the chuck 14 for setting the rivet. Since the rivet can be set completely by turning the movable handlebar a number of times, the rivet can be set smoothly without necessitating a great operating force.

On completion of rivet setting, the movable handlebar 13 is turned away from the fixed handlebar 12 in the opening direction to release the engaging portion 30 from the grooved portion 38 and the bearing groove 42 and return the chuck 14 to its original position. The chuck is returnable with ease simply by turning the movable handlebar 13 once.

FIGS. 9 to 17 show a second preferred embodiment of the invention.

The second embodiment is partly similar to the first in construction and differs therefrom in the features to be described below. Throughout the drawings, like parts are referred to by like reference numerals. With reference to FIGS. 9 to 14, the head assembly of a hand riveter 7 includes a spring supporting member 46 removably inserted in a tubular casing 17 from a rear opening thereof and is removably fitted around a pivot 21. The spring supporting member 46 is tubular and coaxial with the casing 17 and has a spring supporting portion 47 of smaller diameter at one end thereof closer to an expanding spring 19. The rear end of the spring 19 is fitted around and supported by the portion 47.

The spring supporting member 46 is formed, approximately at the midportion of its length, with a pivot bore 48 diametrically extending therethrough. A pivot 21 is loosely fittable in and removable from the pivot bore 48.

In cross section, the pivot bore 48 is defined by a U-shaped edge including a circular arc edge 49 at the rear portion of the bore 48 and a flat edge 50 interconnecting the opposite ends of the U-shaped edge. When positioned in a phantom circle including the circular arc edge 49, the pivot 21 is axially and circumferentially movable relative to the circle. When the pivot 21 is positioned in the bore 48 with a cutout portion 23 of the pivot 21 opposed to the flat edge 50, the pivot 21 is movable axially of the spring supporting member. The flat edge 50 is fittable to the cutout portion 23 in pressing contact therewith by the expanding spring 19 and detachable therefrom. With the edge 50 in engagement with the cutout portion 23, the spring supporting member 46 restrains the pivot 21 from axial movement to hold the casing 17 in connection with an operating bar 20.

When the pivot 21 is turned about its own axis, the cutout portion 23 moves circumferentially of the pivot relative to the flat edge 50 to release the edge 50 from the cutout portion 23, whereby the pivot 21 is positioned in the phantom circle including the circular arc edge 49. When in this position, the pivot 21 is removable from the tubular casing 17 and the operating bar 20. With the pivot thus removed, the chuck 14 is removable from the riveter main body 11 and can be separated into the tubular casing 17, spring supporting member 46, jaw 16, etc.

Figure 14:
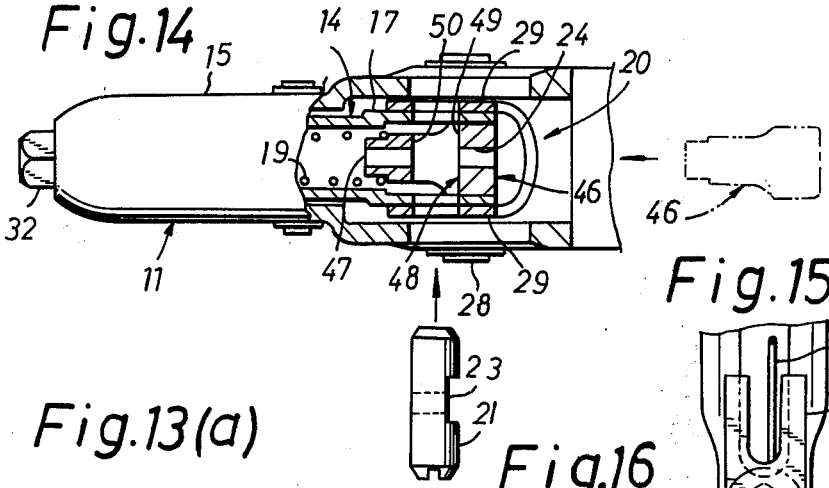
FIG. 14 is a plan view partly in section and showing how to set the pivot and the spring supporting member in place.
Figure 15:
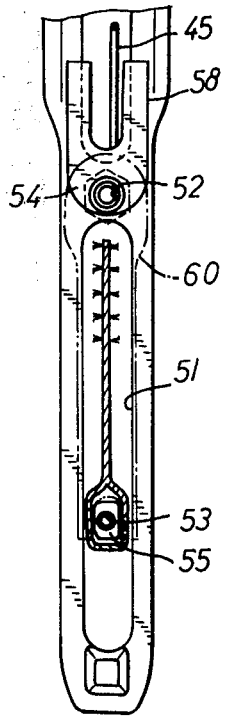
FIG. 15 is a view showing the riveter of FIG. 9 as it is seen in the direction of the line XV—XV in FIG. 9.
Figure 13A:
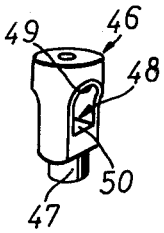
FIG. 13 (*a*) is a perspective view showing a spring supporting member.
Figure 16:
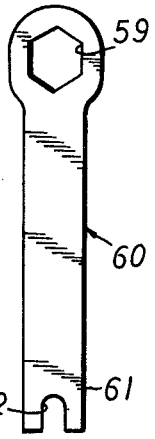
FIG. 16 is a view showing a spanner for handling nosepieces.
Figure 17:
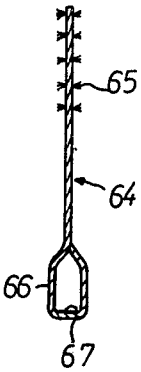
FIG. 17 is a view showing a brush for cleaning the nosepieces.
Figure 13B:
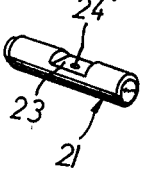

Conversely the chuck 14 can be assembled and mounted on the riveter main body 11 by inserting the jaw 16, wedge member 18 and expanding spring 19 into the tubular casing 17 through the rear end opening thereof, then inserting the spring supporting member 46 into the casing 17 from the broken-line position in FIG. 14 to fit the rear end of the spring 19 around the spring supporting portion 47, further pushing in the member 46 against the action of spring 19 to compress the spring 19 and bring the pivot bore 48 in register with pivot holes in the casing 17 and the operating bar 20, and inserting the pivot through the pivot holes and bore. In this way, the chuck 14 is assembled as housed in the chuck casing 15, with the tubular casing 17 pivotally connected to the operating bar 20. This can be carried out with extreme ease without using any tool.

When the cutout portion 23 of the pivot 21 is brought into pressing contact with the flat edge 50 defining the pivot bore 48 under the action of the spring 19, the spring supporting member 46 holds the pivot 21 against axial movement to keep the tubular casing 17 connected to the operating bar 20 by the pivot 21.

Further when the casing 17 is to be connected to the operating bar 20 with the pivot 21, the pivot 21 is smoothly fittable into the pivot bore 48 without any interference of the flat edge 50 with the cutout portion 23 if the cutout portion 23 is not positioned to oppose the flat edge 50. The cutout portion 23 is thereafter fittable to the flat edge 50 by turning the pivot 21 within the bore 48. When the cutout portion 23 is brought into opposed relation to the flat edge 50, the portion 23 fits to the edge 50 with impact, i.e. with a click, under the action of the expanding spring 19, so that the click audibly indicates the fitting engagement.

Thus the chuck 14 can be assembled, disassembled and mounted easily without using any tool. This facilitates replacement, repair and inspection of the parts.

With reference to FIGS. 9, and 15 to 17, the fixed handlebar 12 is formed on the rear side thereof with a longitudinal channel 51. The channel 51 is provided at the opposite ends thereof with bosses 54, 55 having threaded bores 52, 53, respectively. Bolts 56, 57 are screwed in the threaded bores 52, 53 respectively.

A protecting member 58, made of an abrasion resistant plate and bifurcated, is held to the fixed handlebar 12 by one of the bolts 56, 57. The handle spring 45 is retained at its one end by the bifurcated portion of the protecting member 58. Since the member 58 is provided between opposed portions **12*a* and 13*a* of the fixed handlebar 12 and the movable handlebar 13 where the handlebar 13 comes into contact with the bar 12 when the bar 13 is turned, the member 58 prevents wear on the handlebars 12, 13 due to the contact. The protecting member 58 is useful for preventing the wear that would result, for example, when the fixed handlebar 12 is made of aluminum or aluminum alloy and the movable handlebar 13** made of steel plate.

A spanner 60 has a hexagonal aperture 59 fittable to the nut portions of the nosepiece 32 and spare nosepieces 34, 35. The spanner is fitted around the head of the bolt 56 at its apertured portion 59 and has an operating end 61 which is held to the rear side of the fixed handlebar 12 with the other bolt 57. The spanner 60, which is in the form of a plate, openably closes the channel 51. The operating end 61 is formed with a cutout 62 through which the threaded shank of the bolt 57 is inserted to fasten the spanner 60 to the handlebar by screwing the bolt 57 into the boss.

The spanner 60 is removable from the bolt 57 by slightly loosening the bolt 57 when the nosepiece 32 is to be replaced by the spare nosepiece 34 or 35 in conformity with the size of the rivet to be used. The spanner is easy to attach or remove, eliminating the necessity of carrying a separate spanner for use. The spanner 60, which is attached to the rear side of the fixed handlebar 12, will not interfere with the hand of the operator when the movable handlebar 13 is turned and will not get lost, hence convenient. Furthermore, the opposed edges defining the cutout 62 of the spanner are useful for forcibly opening the opposite ends of retaining rings to remove such rings from the pins for which they are used.

A cleaning brush 64 for cleaning the nosepiece 32 has a brush portion 65 at its one end and an aperture 67 at the other end thereof, namely at the handle end 66. The brush 64 is removably accommodated in the channel 51, with the boss 55 inserted through the aperture 67.

When the bore of the nosepiece is clogged up, for example, with broken pieces of mandrels 10, the brush 64 is taken out from the channel 51 after removing the spanner 60 from the movable handlebar 13 to clean the bore of the nosepiece 32 with the brush portion 65. The nosepiece 32 can be cleaned more readily than when a separate brush is carried about since the brush 64 is very easy to remove and ready for use. The brush 64, which is housed in the channel 51 when not in use, will in no way interfere with the hand of the operator when the movable handlebar 13 is turned and will not get lost, hence convenient.

The spanner 60 and brush 64 can be accommodated in the front side of the fixed handlebar 12, while the spanner 60 can be held in place with a band or the like although not shown.

What is claimed is:

1. A hand riveter the main body of which has a fixed handlebar, a movable handlebar pivotally movable relative to the fixed handlebar, and a chuck for gripping a headed mandrel inserted through a rivet sleeve, the chuck being movable by the pivotal movement of the movable handlebar to pull and snap the mandrel off its head and thereby deform the rivet sleeve for setting the rivet, the hand riveter being characterized in that the riveter comprises an operating bar pivotably supported by the riveter main body and having one end pivoted to the chuck and the other end serving as an engaging portion, a pusher pivoted to the movable handlebar and having a series of grooved portions engageable with the engaging portion, and a bearing member pivoted to the riveter main body and formed with bearing grooves positioned alongside the grooved portions in corresponding relation thereto and engageable with the engaging portion, whereby when the movable handlebar is repeatedly turned, the pusher pushes the engaging portion in engagement with one grooved portion after another to engage the engaging portion correspondingly in one bearing groove after another and move the chuck by the resulting movement of the operating bar for setting the rivet.

2. A hand riveter as defined in claim 1 wherein a handle spring is provided for determining the position of the movable handlebar as spaced apart from the fixed handlebar, the pusher and the bearing member being movable with the movable handlebar to release the engaging portion from the grooved portion and the bearing groove when the movable handlebar is turned from the spaced-apart position in an opening direction against the handle spring, a return spring being provided for returning the chuck to its original position when the engaging portion is in its released position.

3. A hand riveter as defined in claim 1 wherein the chuck comprises a jaw composed of circumferentially arranged divided segments and having an inner bore of variable diameter for gripping the mandrel, a tubular casing having a conical bore for accommodating the jaw to axially push the jaw in contact therewith and thereby reduce the inside diameter of the jaw, an expanding spring accommodated in the tubular casing for biasing the jaw through a wedge member to increase the inside diameter of the jaw, and a pivot connecting the tubular casing to the operating bar and withdrawably inserted axially thereof through the tubular casing and the operating bar, the expanding spring being fitted in and supported by a cutout portion formed in the outer periphery of the pivot to restrain the pivot from axial movement.

4. A hand riveter as defined in claim 1 wherein the chuck comprises a jaw composed of circumferentially arranged divided segments and having an inner bore of variable diameter of gripping the mandrel, a tubular casing hving a conical bore for accommodating the jaw to axially push the jaw in contact therewith and thereby reduce the inside diameter of the jaw, an expanding spring accommodated in the tubular casing for biasing the jaw through a wedge member to increase the inside diameter of the jaw, a pivot connecting the tubular casing to the operating bar and a spring supporting member removably fitted in the tubular casing and removably fitted around the pivot for supporting the expanding spring.

5. A hand riveter as defined in claim 3 wherein the expanding spring is fittable in and removable from the cutout portion by turning the pivot about its own axis.

6. A hand riveter as defined in claim 4 wherein the pivot is loosely fitted in a pivot bore formed in the spring supporting member, and part of the inner periphery of the spring supporting member defining the pivot bore is detachably pressed into fitting contact with a cutout portion formed in the outer periphery of the pivot by the expanding spring to restrain the pivot from axial movement by the spring supporting member.

7. A hand riveter as defined in claim 6 wherein the inner periphery of the spring supporting member defining the pivot bore is partly fittable to and removable from the cutout portion by turning the pivot about its own axis.

* * * * *